United States Patent [19]

Mauer et al.

[11] 4,425,253

[45] Jan. 10, 1984

[54] COGRANULATE OF ALKALI METAL SILICATE AND ALKALI METAL POLYPHOSPHATE, AND PROCESS FOR MAKING IT

[75] Inventors: Alexander Mauer; Horst-Dieter Wasel-Nielen; Renate Adrian, Hürth, all of Fed. Rep. of Germany

[73] Assignee: Hoechst Aktiengesellschaft, Fed. Rep. of Germany

[21] Appl. No.: 464,983

[22] Filed: Feb. 8, 1983

[30] Foreign Application Priority Data

Mar. 6, 1982 [DE] Fed. Rep. of Germany ..... 3208138

[51] Int. Cl.[3] ..... C11D 3/06

[52] U.S. Cl. ..... 252/135; 252/140; 252/523; 23/313 AS; 264/117

[58] Field of Search ..... 252/99, 135, 140, 523; 23/313 AS; 264/117

[56] References Cited

U.S. PATENT DOCUMENTS

| | | | |
|---|---|---|---|
| 3,354,092 | 11/1967 | Perry | 252/523 |
| 4,207,197 | 6/1980 | Davis et al. | 252/135 |
| 4,386,024 | 5/1983 | Maurer et al. | 252/523 |

FOREIGN PATENT DOCUMENTS

| | | |
|---|---|---|
| 48435 | 3/1982 | European Pat. Off. . |
| 2822765 | 11/1978 | Fed. Rep. of Germany . |

*Primary Examiner*—John E. Kittle
*Assistant Examiner*—Hoa Van Le
*Attorney, Agent, or Firm*—Connolly and Hutz

[57] ABSTRACT

The disclosure relates to an abrasion-resistant storable cogranulate consisting of particles with a size of about 0.2 to 2 mm and having an apparent density of 800 to 1100 g/liter, the cogranulate containing (a) about 14.3 to 79.9 weight % of pentasodium tripolyphosphate (b) about 10.9 to 79.9 weight % of an alkali metal silicate (c) about 0.1 to 7.7 weight % of an ammonium polyphosphate of the followiong general formula (I)

$$H_{(n-m)+2}(NH_4)_mP_nO_{3m+1} \quad (I)$$

in which n stands for an integral average value of 10 to 1000, m stands for a whole number of at most n+2 and m/n stands for a value of about 1, and (d) about 0 to 99 weight % water bound to components (a) and (b), based on the possible maximum quantity of hydration water of the components (a) and (b).

7 Claims, No Drawings

COGRANULATE OF ALKALI METAL SILICATE AND ALKALI METAL POLYPHOSPHATE, AND PROCESS FOR MAKING IT

Alkali metal silicates and polyphosphates have long been used in detergent and cleaning agents. For technical reasons and reasons of industrial hygiene, it is desirable to use these substances in the form of granulated material. As a result, it is possible not only effectively to prevent the cleaning or detergent agent from dusting on packing it, but also considerably to reduce the product's tendency to coalesce during storage. Heretofore, it has been customary for these two substances to be granulated separately and for the granulates to be mixed together. This is however not fully satisfactory inasmuch as the silicates and polyphosphates are inhomogeneously distributed in the detergent or cleaning agent. While cogranulates consisting of the two substances have already been described, the fact remains that they present technically adverse effects, or that their preparation is very expensive.

A process for making a cogranulate of sodium tripolyphosphate and alkali metal silicate has been described in DE-OS 20 46 658. The feed material used therein is a dry mixture containing the two components in the desired ratio which is granulated with the use of an excess of water, namely 50 to 70 weight %, based on the water bound in the final product. Next, the granulate is dried to remove water in excess and obtain a dry product for sale.

A granular detergent of improved abrasion resistance and a process for making it have been described in DE-OS 20 53 177. The granulate consists essentially of a silicate core and encircling envelope of polyphosphate, especially sodium tripolyphosphate. The granulate is made by preparing a paste of the core constituents, granulating the paste in a mixer and coating the individual granulate particles with polyphosphate. This is a rather expensive procedure that is effected initially with the use of an excess of water for which it is ultimately necessary to be removed by drying.

A further process for making a cogranulate of sodium tripolyphosphate and alkali metal silicate has been described in DE-OS 24 54 448, wherein granulated sodium tripolyphosphate and alkali metal silicate are placed in a rotary tube, water is sprayed thereon and the whole is cooled by means of air flowing countercurrently through the tube. The product so made suffers from the disadvantage that its surface consists exclusively of alkali metal silicate which naturally is dissolved first during the cleaning or washing operation; needless to say this is not desirable.

A still further process for making a cogranulate consisting of an inner silicate core and outer tripolyphosphate envelope has been described in DE-OS 28 22 765. The water needed for granulating is practically completely contained in the tripolyphosphate envelope. This is granulate which is liable to undergo increased abrasion during processing.

We have now unexpectedly found that it is possible to avoid the adverse effects associated with the granulates and processes for making them described heretofore and obtain a mechanically solid cogranulate of sodium tripolyphosphate and alkali metal silicate by substituting water containing a certain proportion of an ammonium polyphosphate as a binder for the water used heretofore as a granulating aid.

The present invention relates more particularly to an abrasion-resistant storable cogranulate consisting of particles with a size of about 0.2 to 2 mm and having an apparent density of 800 to 1100 g/liter, the cogranulate containing (a) about 14.3 to 79.9 weight % of pentasodium tripolyphosphate (b) about 10.9 to 79.9 weight % of an alkali metal silicate (c) about 0.1 to 7.7 weight % of an ammonium polyphosphate of the following general formula (I)

$$H_{(n-m)+2}(NH_4)_mP_nO_{3m+1} \quad (I)$$

in which n stands for an integral average value of 10 to 1000, m stands for a whole number of at most n+2 and m/n stands for a value of about 1, and (d) about 0 to 99 weight % water bound to components (a) and (b), based on the possible maximum quantity of hydration water of the components (a) and (b).

The alkali metal silicate component comprises, for example, sodium methasilicate of the formula $Na_2SiO_3$ containing 5 mols water of hydration, in the hydrated state.

The quantity of water bound in the final granulate preferably is 0 to 65 weight %, based on the possible maximum total quantity of hydration water of components (a) and (b).

The invention also relates to a process for making the abrasion-resistant and storable cogranulate consisting of particles with a size of about 0.2 to 2 mm and having an apparent density of 800 to 1100 g/liter, which comprises mixing pulverulent pentasodium tripolyphosphate containing at most 5 weight % of water of hydration with an anhydrous, partially or completely hydrated sodium silicate in a ratio by weight of 80:20 to 20:80; granulating the resulting mixture by spraying at about 1 to 20 weight % aqueous solution of the ammonium polyphosphate of general formula (I) thereonto, the quantity of water being selected so that the granulate has about 10 to 65 weight % of water bound therein, based on the possible maximum quantity of hydration water of the pentasodium tripolyphosphate and alkali metal silicate; and tempering the granulate at temperatures of 200° to 500° C., if desired.

A preferred feature of the process of this invention provides for the pentasodium tripolyphosphate to consist of particles of which 90% have a size smaller than 0.8 mm and 60% have a size smaller than 0.4 mm, and preferably 90% have a size smaller than 0.4 mm, and to contain at most 5 weight %, preferably at most 1.5 weight % water of hydration. A further feature provides for the alkali metal silicate corresponding, for example, to the formula $Na_2SiO_3$, to contain a $Na_2O$-excess of 25%.

The invention finally provides for the alkali metal silicate to contain at most 10 weight % water of hydration, prior to granulation.

It is possible for the two solid feed components to be either premixed in a separate device or for them to be introduced separately in the form of two regularly flowing product streams into the granulating device, in which they are kept under agitation and become satisfactorily mixed. The granulation can be effected with the use of a standard granulating plate, rotary tube, mixer, fluidized bed reactor or the like.

The phase-I or phase-II content of the tripolyphosphate selected is not very critical; it is preferable however to use more rapidly hydrating grades.

The ammonium polyphosphate solution should preferably be sprayed on to the feed mixture using a dual feed nozzle and compressed air, whereby the mixture warming up during the exothermal hydration reaction is simultaneously cooled.

In order to produce a granulate of a given particle size, it is possible for the granulate obtained to be sieved, if desired. When it is desirable to make anhydrous granulate, it is preferably for the granulate containing water of crystallization to be heat treated at 200° to 500° C. in a rotary tube, for example, or to be calcined.

The process of this invention and the technically beneficial effects of the resulting granulate will now more fully be described in the following Examples.

EXAMPLE 1

A mixture of sodium tripolyphosphate (STPP) and sodium metasilicate in a ratio by weight of 2:1 was metered at a rate of 70 kg/h into a rotary tube 2 m long and 60 cm wide. The STPP contained 0.8 wgt % $H_2O$, 18% phase-I, and 99% of its particles had a size of less than 0.4 mm. The sodium metasilicate was analyzed and found to contain 45.6% $SiO_2$; 50.4% $Na_2O$; 2.2% $H_2O$; and 3% of its particles had a size of less than 0.2 mm.

9 l/h of a 4 wgt % aqueous solution of ammonium polyphosphate was sprayed through a dual feed nozzle by means of compressed air on to the powder mixture kept under agitation in the rotary tube which rotated at a speed of 15 rpm. The ammonium polyphosphate (APP) had a mean chain length of about 400 and contained 72.4% $P_2O_5$. The temperature of the powder mixture during granulation was about 20° C.

A cogranulate with the following particle size distribution was obtained:

>2 mm=1.1%

>0.7 mm=45.5%

>0.35 mm=61.0%

>0.2 mm=84.2%

Granulate with a particle size of >0.2 mm and <2.0 mm was obtained in a yield of 83%. The cogranulate was analyzed and found to contain: $Na_2O$=40.9%; $SiO_2$=14.0%; $P_2O_5$=35.1%; $H_2O$=9.6%. 94.5% of the $P_2O_5$ of the phosphate constituent was contained in form of tripolyphosphate in the granulate. The abrasion resistance of the granulate was determined by the drum test method and found to be 72%>0.2 mm. The granulate had an apparent density of 950 g/l and was reliably flowable after storage for 4 weeks.

EXAMPLE 2

The procedure was as in Example 1 but 90 kg of a mixture of sodium tripolyphosphate and sodium metasilicate in a ratio by weight of 1:2 was granulated. The resulting granulate had the following particle size distribution: >2.0 mm=2.9% >0.7 mm=70.0%; >0.35 mm=90.5%; >0.2 mm=98.8%. The cogranulate was analyzed and found to contain: $Na_2O$=43.8%; $SiO_2$=29.2% $P_2O_5$=17.8%; $H_2O$=8.5%. Further typical data of the granulate were as follows: tripolyphosphate content=95.3% of $P_2O_5$ constituent; apparent density=1090 g/l. Abrasion resistance=75%>0.2 mm and good storage life; the granulate was reliably flowable after storage in bags over a period of 4 weeks.

EXAMPLE 3

The procedure was as in Example 2 but the ammonium polyphosphate solution was supplied at a rate of 7.5 l/h. A granulated product which had the following particle size distribution was obtained: >2.0 mm=1.0%; >0.7 mm=53.4%; >0.35 mm=79.2%; >0.2 mm=94.1%. The cogranulate was analyzed and found to contain: $Na_2O$=44.2%; $SiO_2$=29.5%; $P_2O_5$=18.1%; $H_2O$=7.3%. The tripolyphosphate content was 93.8% of the $P_2O_5$-constituent, the apparent density was 1030 g/l and the abrasion resistance was 72%>0.2 mm. The storage life was as that of the granulate obtained in Example 2.

EXAMPLE 4

The granulation was effected in a rotary tube as described in Example 1 but 120 kg/h of a 2:1 (ratio by weight) mixture of sodium tripolyphosphate and sodium metasilicate which was composed of $Na_2O$=50.5%; $SiO_2$=48.3%; $H_2O$<0.5%; average particle size=0.15 mm was introduced into the rotary tube. 27 l/h of a 4 weight % aqueous solution of ammonium polyphosphate was sprayed thereonto. The resulting granulated product had the following particle size distribution: >2.0 mm=3.1%; >0.7 mm=67%; >0.35 mm=83.6%; >0.2 mm=94.3%. The cogranulate was analyzed and found to contain: $Na_2O$=37.9%; $SiO_2$=13.3%; $P_2O_5$=32.9%; $H_2O$=15.1%. Tripolyphosphate content=94.0% of $P_2O_5$-constituent. The apparent density was 930 g/l and the abrasion resistance 75%>0.2 mm. The storage life was as that of the product of Example 1.

EXAMPLE 5

A rotary tube 4 m long and 0.8 m wide was fed with 80 kg/h sodium tripolyphosphate as described in Example 1 and 40 kg/h sodium metasilicate as described in Example 4. In a first unheated zone 1.5 m long inside the tube, 27 l/h of a 4 weight % aqueous ammonium polyphosphate solution was sprayed as described in Example 1, using a dual feed nozzle and compressed air on to the material kept under agitation. Next, the granulated product was dehydrated in a second successive zone 2.5 m long by passing burner gas at 600° C. therethrough. The resulting product had the following particle size distribution: >2.0 mm=4.8%; >0.7 mm=25.2%; >0.35 mm=75.2%; >0.2 mm=98.4%. The cogranulate was analyzed and found to contain: $Na_2O$=45.2% $SiO_2$=15.9% $P_2O_5$=38.8%; $H_2O$=<0.3%; tripolyphosphate content=95.1% of $P_2O_5$-constituent. The apparent density was 940 g/l and the abrasion resistance=86%>0.2 mm. The storage life was as that of the product of Example 4.

EXAMPLE 6

The procedure was as in Example 5 but 40 kg sodium tripolyphosphate and 80 kg sodium metasilicate were introduced into the rotary tube. In addition to this, the two zones inside the tube were operated at room temperature. A product which had the following particle size distribution was obtained: >2 mm=2.3%; >0.7 mm=67.3%; >0.35 mm=94.7%; >0.2 mm=99.5%. The cogranulate was analyzed and found to contain: $Na_2O$=40.2%; $SiO_2$=26.8%; $P_2O_5$=16.4%; $H_2O$=15.7%. The tripolyphosphate content was 93.9% of the $P_2O_5$-constituent, the apparent density was 980 g/l and the abrasion resistance=82%>0.2 mm. The storability was very good even after 4 weeks.

EXAMPLE 7

15 kg of a mixture of sodium tripolyphosphate and sodium metasilicate in a mixing ratio of 2:1 was granulated by spraying a 4 weight% aqueous ammonium polyphosphate solution as described in Example 1 thereonto, the spraying being effected on a granulating plate which had a diameter of 1 m, was inclined at an angle of 45° and rotated at a speed of 55 rpm. The typical data of STPP were as follows: $H_2O$-content=>0.3 wgt%; phase-I content=29%; particle distribution >0.4 mm=98.7%>0.2 mm=91%.

The sodium metasilicate was the same as that described in Example 1. 1.5 l aqueous solution was sprayed within 30 minutes until 20° C. A granular product which had the following particle size distribution was obtained: <2.0 mm=1.4%; <0.7 mm=55.5%; <0.35 mm=69.3%; <0.2 mm=92.1%. The cogranulate was analyzed and found to contain: $Na_2O$=40.8%; $SiO_2$=14.1%; $P_2O_5$=34.9%; $H_2O$=9.2%. The tripolyphosphate content was 94.6% of the $P_2O_5$ constituent, the apparent density was 920 g/l and the abrasion resistance of the granulate 73%>0.2 mm. Even after storage over a period of 10 weeks in a plastics bag, the cogranulate was flowable and could not be found to have coalesced.

We claim:

1. Abrasion-resistant storable cogranulate consisting of particles with a size of about 0.2 to 2 mm and having an apparent density of 800 to 2200 g/liter, the cogranulate containing (a) about 14.3 to 79.9 weight% of pentasodium tripolyphosphate (b) about 10.9 to 79.9 weight% of an alkali metal silicate (c) about 0.1 to 7.7 weight% of an ammonium polyphosphate of the following general formula (I)

$$H_{(n-m)+2}(NH_4)_mP_nO_{3m+1} \quad (I)$$

in which n stands for an integral average value 10 to 1000, m stands for a whole number of at most n+2 and m/n stands for a value of about 1, and (d) about 0 to 99 weight% water bound to components (a) and (b), based on the possible mazimum quantity of hydration water of the components (a) and (b).

2. Granulate as claimed in claim 1, wherein the alkali metal silicate is sodium metasilicate.

3. Granulate as claimed in claim 1, wherein the quantity of bound water is 0 to 65 weight%, based on the possible maximum quantity of hydration water of components (a) and (b).

4. Process for making an abrasion-resistant and storable cogranulate consisting of particles with a size of about 0.2 to 2 mm and having an apparent density of 800 to 1100 g/liter, which comprises mixing pulverulent pentasodium tripolyphosphate containing at most 5 weight% of water of hydration with an anhydrous, partially or completely hydrated sodium silicate in a ratio by weight of 80:20 to 20:80; granulating the resulting mixture by spraying at about 1 to 20 weight% aqueous solution of the ammonium polyphosphate of general formula (I) thereonto the quantity of water being selected so that the granulate has about 10 to 65 weight% of bound water contained therein, based on the possible maximum quantity of hydration water of the pentasodium tripolyphosphate and alkali metal silicate; and tempering the granulate at temperatures of 200° to 500° C.

5. The process as claimed in claim 4, wherein the pentasodium tripolyphosphate consists of particles of which 90% have a size smaller than 0.8 mm and 60% have a size smaller than 0.4 mm, and contains at most 5 weight% water of hydration.

6. The process as claimed in claim 4, wherein the alkali metal silicate corresponds to the formula $Na_2SiO_3$.

7. The process as claimed in claim 4, wherein the alkali metal silicate contains at most 10 weight% water of hydration.

* * * * *